US008128445B2

(12) United States Patent
Cunningham et al.

(10) Patent No.: US 8,128,445 B2
(45) Date of Patent: Mar. 6, 2012

(54) COLD WEATHER SURVIVAL APPARATUS

(75) Inventors: Alan D. Cunningham, Yellowknife (CA); Gary Amstutz, Surrey (CA)

(73) Assignee: Alanco Holdings Ltd., Yellowknife, Northwest Territories (CA)

( * ) Notice: Subject to any disclaimer, the term of this patent is extended or adjusted under 35 U.S.C. 154(b) by 0 days.

(21) Appl. No.: 12/769,515

(22) Filed: Apr. 28, 2010

(65) Prior Publication Data

US 2010/0279564 A1 Nov. 4, 2010

Related U.S. Application Data

(60) Provisional application No. 61/174,420, filed on Apr. 30, 2009.

(51) Int. Cl.
*B63C 9/08* (2006.01)

(52) U.S. Cl. ..... 441/108

(58) Field of Classification Search ..... 441/106, 441/108, 80
See application file for complete search history.

(56) References Cited

U.S. PATENT DOCUMENTS

D348,565 S * 7/1994 Cummins ..... D3/215
5,341,975 A * 8/1994 Marinescu ..... 224/666
5,827,098 A * 10/1998 Cunningham ..... 441/82
6,213,365 B1 * 4/2001 Stocke et al. ..... 224/665
7,007,832 B1 * 3/2006 Payne ..... 224/660
7,699,197 B2 * 4/2010 Panosian et al. ..... 224/665

OTHER PUBLICATIONS

Budak, Jasmine, et al., "Edisons of the North", Up Here Magazine, Apr. 2005, pp. 48-51.

* cited by examiner

*Primary Examiner* — Stephen Avila
(74) *Attorney, Agent, or Firm* — Oyen Wiggs Green & Mutala LLP

(57) ABSTRACT

Apparatus for cold weather survival comprises an elongated belt body comprising a piece of buoyancy-providing material. The belt body is sized such that end portions thereof overlap when the belt body is wrapped around a user's waist. The belt body has an inner side which faces the user and an outer side which faces away from the user. One or more fasteners are provided for holding the belt body in place around the user's waist. A plurality of flotation devices and a plurality of pockets are attached to the outer side of the belt body. A sleeve is attached to the outer side the belt body, and positioned such that when the belt body is wrapped around the user's waist, the sleeve is horizontally-oriented and located in front of the user. A telescoping pole is held by the sleeve across the front of the user.

16 Claims, 6 Drawing Sheets

COLD WEATHER SURVIVAL APPARATUS

REFERENCE TO RELATED APPLICATION

This application claims the benefit under 35 U.S.C. §119 of U.S. patent application No. 61/174,420 filed on 30 Apr. 2009 and entitled COLD WEATHER SURVIVAL APPARATUS, which is hereby incorporated by reference herein.

TECHNICAL FIELD

The invention relates to apparatus for cold weather survival.

BACKGROUND

Many people spend time in remote areas during cold weather, for both work and play. In particular, people spend time on frozen lakes and other waterways, both for recreational activities such as ice skating, ice fishing and snowmobiling, and also activities such as commercial trucking in remote areas where freight may be hauled over frozen bodies of water. If an accident occurs and a person falls through the ice, or if a person becomes stranded in the cold in a remote location, their chances of survival may be improved if they are properly equipped with appropriate survival gear.

U.S. Pat. No. 5,827,098 to Cunningham discloses a cold weather life saving device which may be worn about a user's waist. The device may include a kit of equipment which would be useful in an emergency cold weather situation.

The inventors have determined a need for improved apparatus for cold weather survival.

SUMMARY

One aspect of the invention provides an apparatus for cold weather survival comprising an elongated belt body comprising a piece of buoyancy-providing material. The belt body is sized such that end portions thereof overlap when the belt body is wrapped around a user's waist. The belt body has an inner side which faces the user when the belt body is wrapped around the user's waist and an outer side which faces away from the user when the belt body is wrapped around the user's waist. One or more fasteners are provided for holding the belt body in place around the user's waist. A plurality of flotation devices and a plurality of pockets are attached to the outer side of the belt body. One or more mounting mechanisms are coupled to the outer side the belt body. A telescoping pole is held by the one or more mounting mechanisms.

Another aspect of the invention provides a telescoping pole which is separable into a telescoping part and a non-telescoping part. The telescoping part has a reduced diameter portion at one end thereof sized to be received in an opening defined in an end of the non-telescoping part. The reduced diameter portion of the telescoping part defines an L-shaped slot therein and the non-telescoping part comprises a protrusion extending into the opening. The protrusion is configured to be received in the slot such that the telescoping part and the non-telescoping part may be secured together by inserting the reduced diameter position into the opening with the protrusion aligned with the slot, then twisting the telescoping part and the non-telescoping part relative to each other. The telescoping part may comprise a first spike extending from the reduced diameter portion, and the non-telescoping part may comprise a second spike at the end thereof opposite the opening, such that the user can establish first and second handholds on a surface by pressing the first and second spikes into the surface. The non-telescoping part may also comprise a retractable spike cover which is biased into an extended position wherein the retractable spike cover covers the second spike, whereby the retractable spike cover may be forced back to a retracted position to expose the second spike by pressing the end of the non-telescoping part opposite the opening against the surface.

Further aspects of the invention and details of example embodiments are described below.

BRIEF DESCRIPTION OF DRAWINGS

In drawings which illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
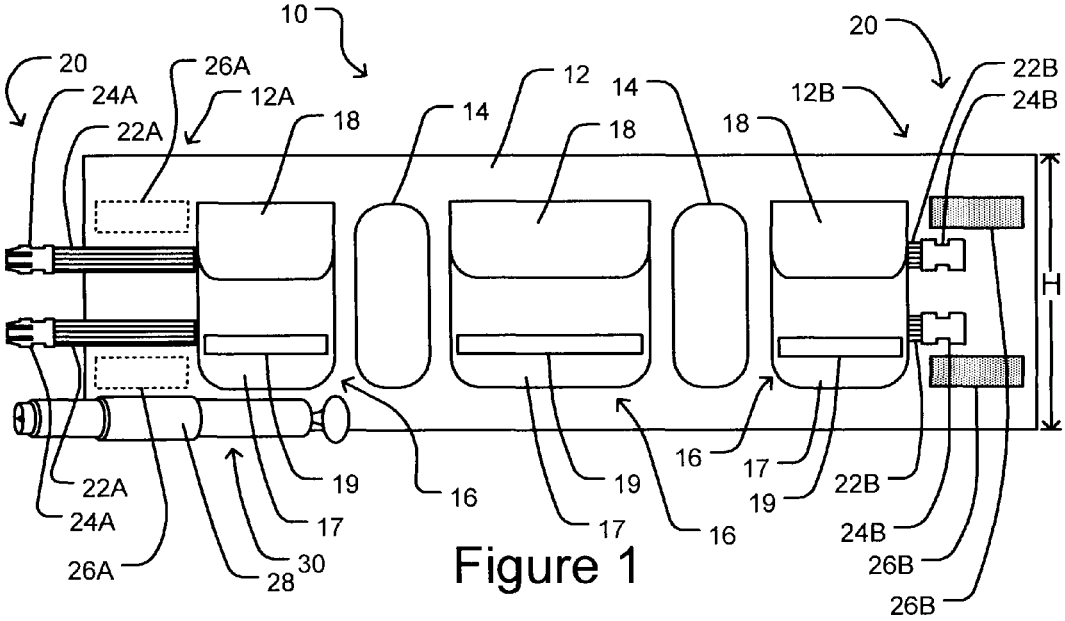
FIG. 1 shows a cold weather survival apparatus according to one embodiment of the invention.

FIG. 1 shows a cold water life saving apparatus 10. Apparatus 10 comprises a belt body 12 having a plurality of floatation devices 14 and pockets 16 thereon. In the illustrated embodiment, apparatus 10 comprises two flotation devices 14 interleaved between three pockets 16. Other numbers and positioning of flotation devices 14 and pockets 16 are also possible.

Belt body 12 may comprise a piece of wetsuit or wetsuit-like material such as, for example, neoprene or the like, which provides buoyancy to apparatus 10. Belt body 12 may be generally rectangular, as shown in FIG. 1, or may have other shapes in other embodiments. Belt body 12 may be elongated in a horizontal direction (from the viewpoint of a viewer of FIG. 1) such that belt body 12 can be wrapped around a user's waist with end portions 12A and 12B at least partially overlapping. In some embodiments, belt body 12 may have a height H such that when belt body 12 is wrapped around a user's waist, belt body 12 covers the user's lumbar region and provides lumbar support. Height H may be in the range of 9 to 12 inches, and may be about 10.5 inches in some embodiments.

Flotation devices 14 may comprise masses of low density material. Flotation devices 14 may comprise, for example, polyurethane closed cell foam in some embodiments. Flotation devices 14 may be attached to, sewn into, or otherwise secured to belt body 12 at locations in between pockets 16. For example, each flotation device 14 may be enclosed by a neoprene sleeve which is sewn to belt body 12.

Flotation devices 14 may be selected such that the combined buoyancy of flotation devices 14 and belt body 12 would be sufficient to keep a 200 lb user afloat in some embodiments. In other embodiments, higher or lower combined buoyancies could be provided, depending on the expected use of apparatus 10.

Each pocket 16 may comprise a pouch 17 covered by a flap 18. Reflective strips 19 may be provided on pouches 17 to increase the visibility of apparatus 10. Flaps 18 may be held down by hook and loop fasteners (not shown) such as, for example, Velcro™ fasteners, in some embodiments. In other embodiments, flaps 18 may be held down by snaps, zippers, buttons, or other means.

Pouches 16 provide storage for survival items, and may also have room for user's personal item, if desired. In some embodiments, pouches 16 provide storage for a small tent, a "space" blanket, matches, a sportsman's saw, water purification tablets, a long-burning candle, a small flashlight or penlight, a walkie-talkie or cellular telephone, a bundled cord or string, and a pocket knife.

When belt body 12 is wrapped around a user's waist, the overall thickness of apparatus 10 determines how far apparatus 10 extends out from the user's body. Increased thickness can increase the likelihood that apparatus 10 could interfere with the user's movements and/or comfort when wearing apparatus 10. Flotation devices 14 and pockets 16 may be configured to minimize the thickness of apparatus 10 in some embodiments, while maintaining desired buoyance and storage capacity. Flotation devices 14 protrude from the "outer" side of belt body 12 (i.e., the side shown in FIG. 1) by about one inch in some embodiments. Pockets 16 may also protrude from the outer side of belt body 12 by about one inch in some embodiments although this distance may vary depending on the size and/or shape of items stored in pockets 16. The "inner" side of belt body 12 (i.e., the side opposite from the side shown in FIG. 1) may be substantially flat and smooth, to provide increased comfort to the user.

Fasteners 20 are provided at either end of belt body 12 for securing apparatus 10 in position about a user's waist. Fasteners 20 may comprise straps 22A and 22B at either end of belt body 12. Straps 22A have buckle portions 24A thereon, which are configured to be releasably retained in corresponding buckle portions 24B on straps 22B. Any or all of straps 22A, 22B may be adjustable in length. Fasteners 20 may also comprise hook and loop fastener portions 26A and 26B on either end of belt body 12. Portions 26A are located on the inner side of belt body 12, and positioned to overlap with and attach to portions 26B on the outer side of belt body 12 when belt body 12 is wrapped around a user's waist.

Apparatus 10 also comprises a mounting mechanism for holding a telescoping pole 30. The mounting mechanism may securely hold pole 30 with respect to belt body 12 such that pole 30 does not bounce or swing as the user moves. In some embodiments, the mounting mechanism is configured to hold pole 30 in a fixed orientation with respect to belt body 12. In some embodiments, the mounting mechanism is configured to hold pole 30 in an adjustable orientation with respect to belt body 12.

In the embodiment illustrated in FIG. 1, the mounting mechanism comprises a sleeve 28 for holding a telescoping pole 30. Sleeve 28 may be positioned such that when a user is wearing apparatus 10, pole 30 is held in place across the front of the user's hips.

Figure 1A:
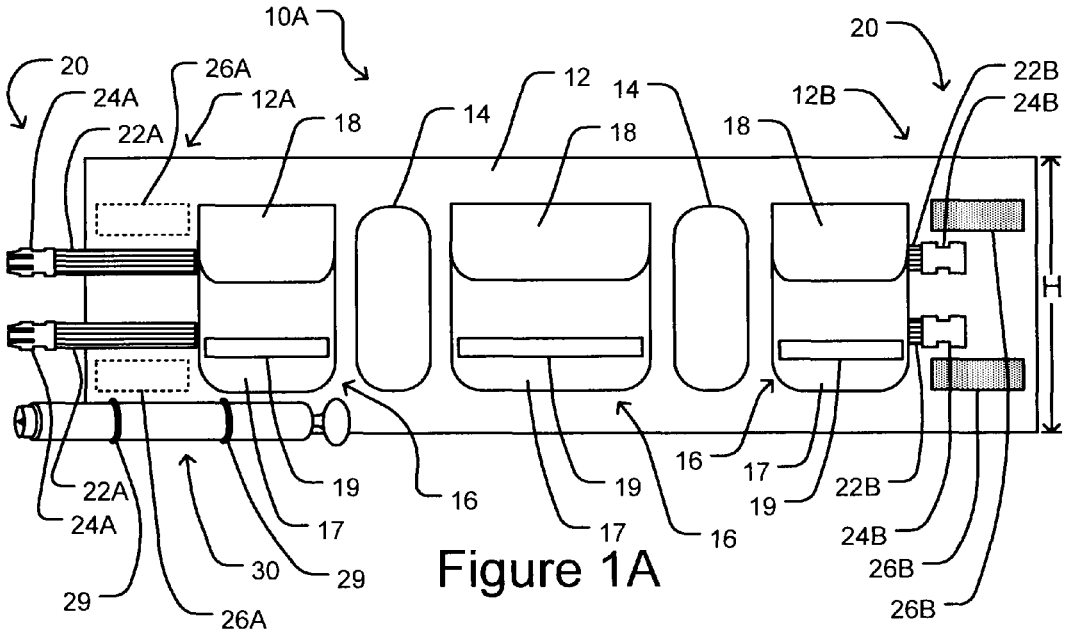
FIG. 1A shows a cold weather survival apparatus according to another embodiment of the invention.

Different embodiments may have different mounting mechanisms. For example FIG. 1A shows apparatus 10A wherein the mounting mechanism comprises two loops 29 made from a stretchable material. Apparatus 10A is otherwise the same as apparatus 10 of FIG. 1. In the illustrated embodiment, loops 29 are arranged such that when a user is wearing apparatus 10, pole 30 is held in place across the front of the user's hips. Loops 29 may be positioned differently in other embodiments to hold pole 30 in different orientations, and more than two loops may be provided in some embodiments. In some embodiments multiple sets of loops 29 may be provided to permit pole 30 to be secured at a variety of positions and orientations with respect to belt body 12.

Figure 1B:
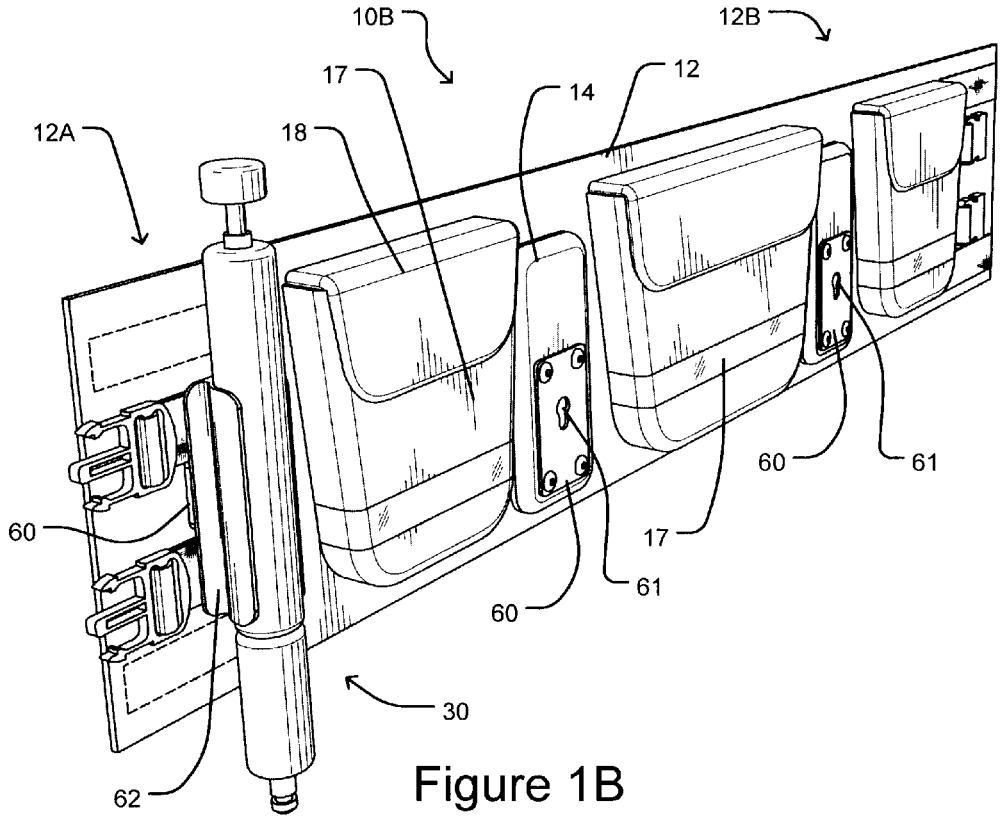
FIG. 1B shows a cold weather survival apparatus according to another embodiment of the invention.
Figure 1C:
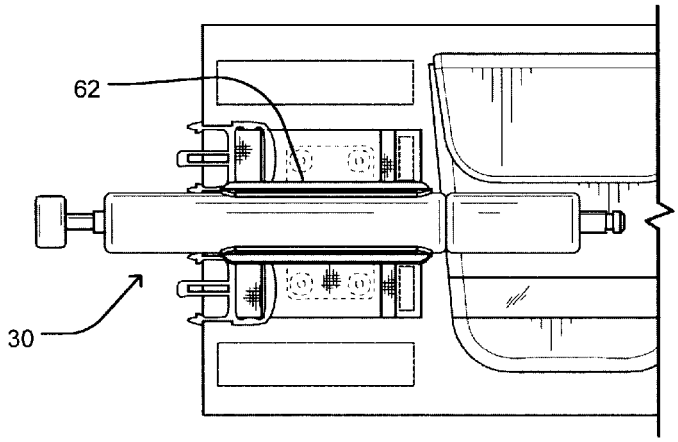
FIG. 1C shows a portion of the cold weather survival apparatus of FIG. 1B with the telescoping pole mounted in a different orientation.

FIG. 1B shows apparatus 10B wherein the mounting mechanism comprises a plurality of mounting plates 60 to which a clip 62 configured to hold pole 30 may be attached. Apparatus 10B is otherwise the same as apparatus 10 of FIG. 1. Clip 62 is rotatable with respect to mounting plate 60, such that the orientation of pole 30 with respect to belt body may be adjusted. For example, FIG. 1C shows pole 30 orientated generally parallel to belt body 12.

In the illustrated embodiment, three mounting plates 60 are provided. One mounting plate 60 is located on end portion 12A, such that when clip 62 is attached thereto, pole 30 can be clipped to the front of a user wearing apparatus 10B. Additional mounting plates 60 are attached atop flotation devices 14, such that clip 62 may be attached to hold pole 30 on either the left side of a user wearing apparatus 10B (as shown in FIG. 1F), or the right side of a user wearing apparatus 10B (as shown in FIG. 1G).

Figure 1D:
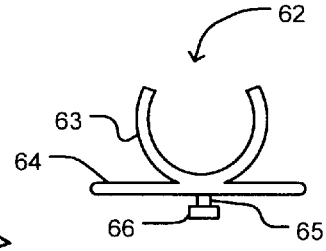
FIG. 1D is an end view of the clip of the cold weather survival apparatus of FIG. 1B.
Figure 1E:
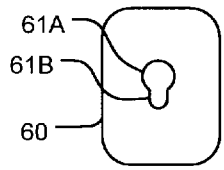
FIG. 1E shows a mounting plate of the cold weather survival apparatus of FIG. 1B.
Figure 1F:
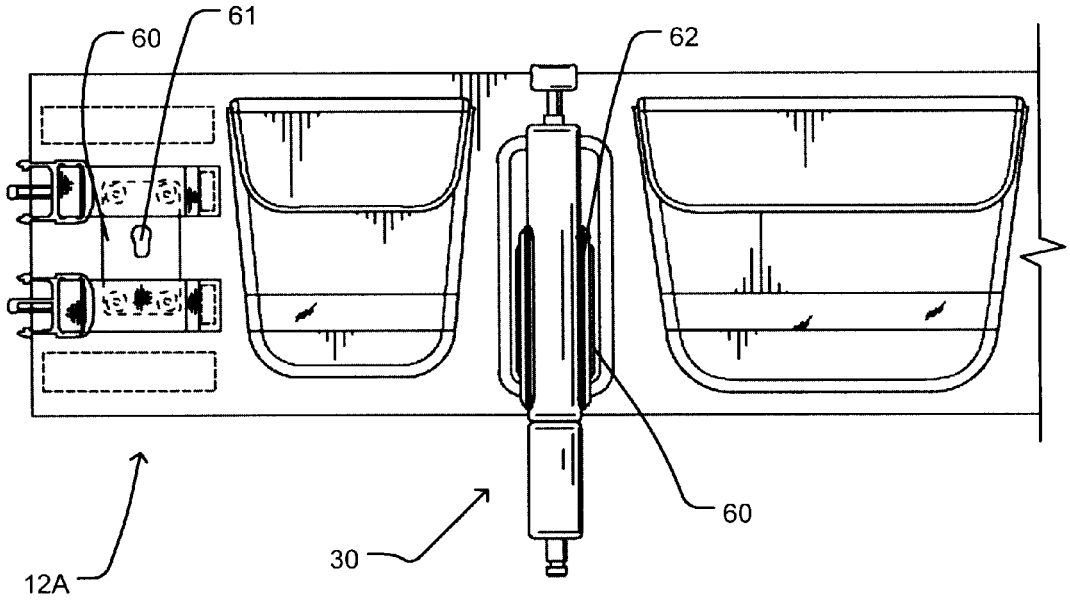
FIGS. 1F and 1G illustrate alternative locations for mounting the telescoping pole on the cold weather survival apparatus of FIG. 1B.
Figure 1G:
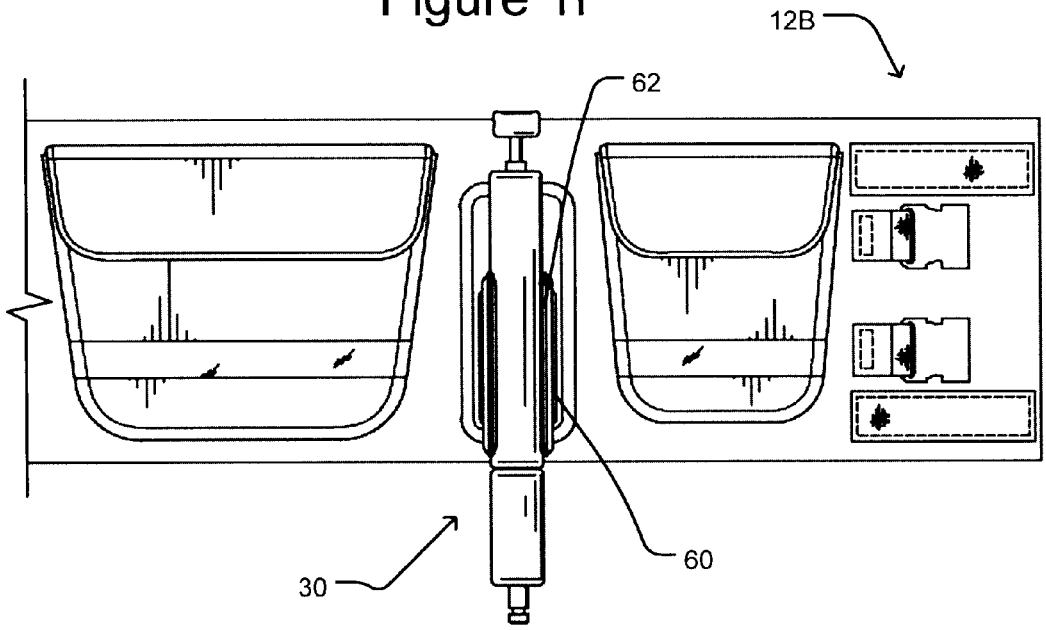

As best seen in FIG. 1D, clip 62 comprises an arcuate clip portion 63 extending from one side of a generally planar base 64. A post 65 having an enlarged head 66 extends from the other side of base 64. As best seen in FIG. 1E, each mounting plate 60 has an aperture 61 defined therein comprising a wide portion 61A and a narrow portion 61B. Head 66 is sized to fit through wide portion 61A, but not narrow portion 61B, such that clip 62 may be attached to mounting plate 60 by inserting head through wide portion 61A and then sliding clip 62 downwardly such that post 65 is received in narrow portion 61A.

Figure 2:
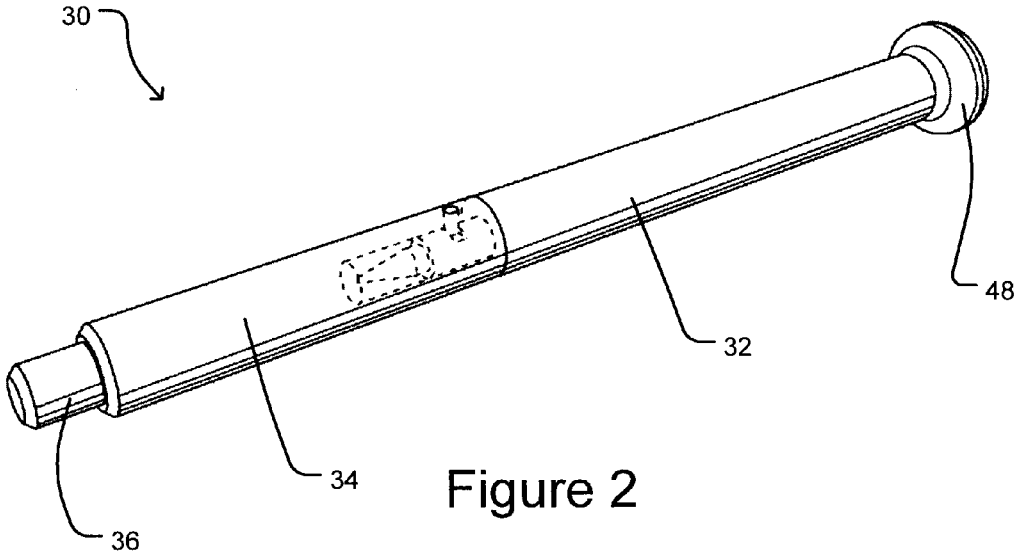
FIG. 2 shows a telescoping pole according to one embodiment of the invention.
Figure 3:
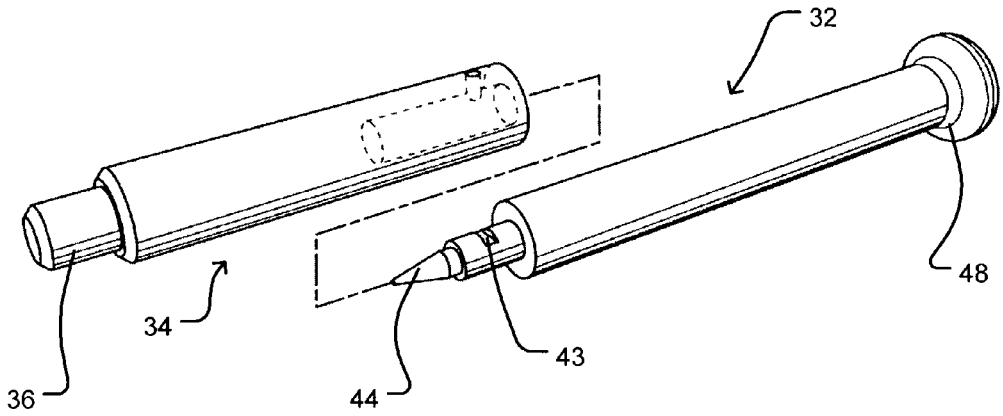
FIG. 3 shows the pole of FIG. 2 separated into two parts.
Figure 5:
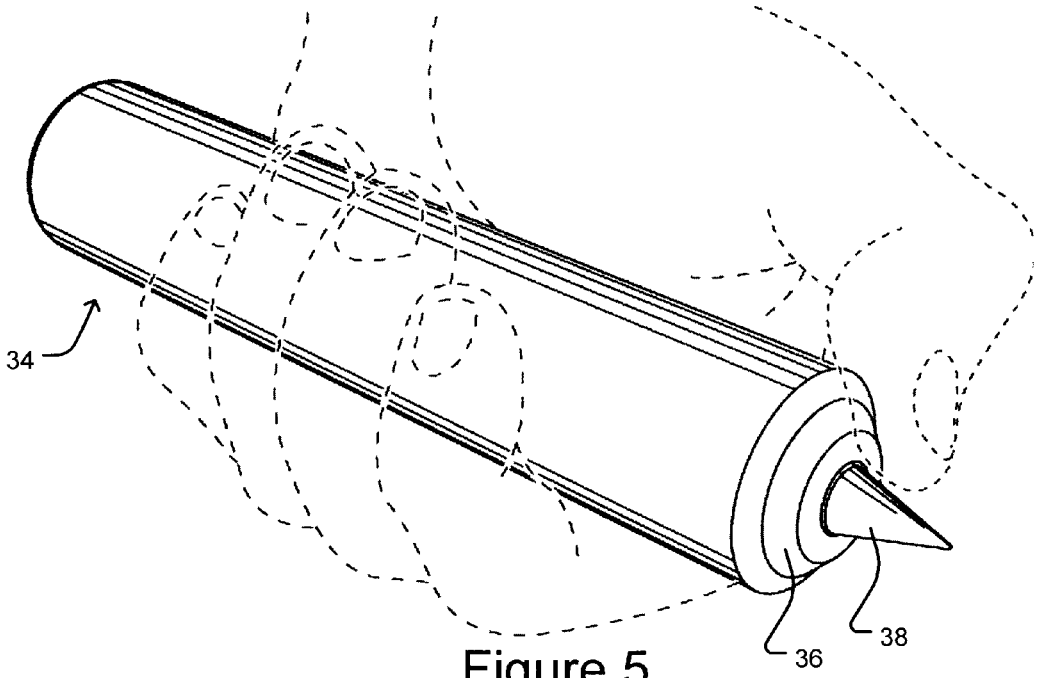
FIG. 5 shows the non-telescoping part of the pole of FIG. 3 with the spike cover pulled back to show the spike.

As shown in FIGS. 2 and 3, telescoping pole 30 comprises a telescoping part 32 and a non-telescoping part 34. Non-telescoping part 34 has a retractable spike cover 36 at one end thereof, which is biased into an extended position, as shown in FIGS. 2 and 3, to cover a spike 38 (see FIG. 5). As shown in FIG. 5, when spike cover 36 is forced back to the retracted position, spike 38 is exposed. A user can thus use non-telescoping part 34 to establish a handhold on a surface such as, for example a sheet of ice, by pressing the end of non-telescoping part 34 having spike cover 36 and spike 38 against the surface.

The opposite end of non-telescoping part 34 defines an opening 40 sized to receive a reduced diameter portion 42 of telescoping part 32. A spike 44 is provided on the end of reduced diameter portion 42. A user can also use telescoping part 34 to establish a handhold on a surface such as, for example a sheet of ice, by pressing spike 44 into the surface.

Figure 3A:
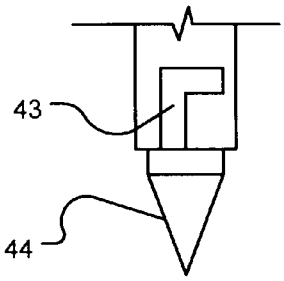
Figure 4:
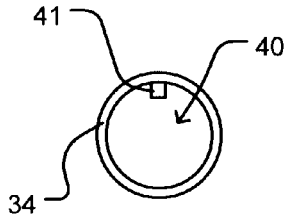
FIG. 4 shows an end view of the non-telescoping part of the pole of FIG. 3.

As shown in FIG. 4, a protrusion 41 extends inwardly into opening 40. Protrusion 41 is sized to be received in a slot 43 (see FIGS. 3 and 3A) defined in reduced diameter portion 42 of telescoping part 32. Slot 43 extends longitudinally along reduced diameter portion 42, then makes a right angle turn and extends radially, such that slot 43 is generally L-shaped. Protrusion 41 is positioned such that when reduced diameter portion 42 is fully inserted into opening 40, protrusion 41 is located at the bend in slot 43, such that telescoping part 32 and non-telescoping part 34 may be rotated respect to one another in order to securely hold telescoping part 32 and non-telescoping part 34 together.

Figure 6:
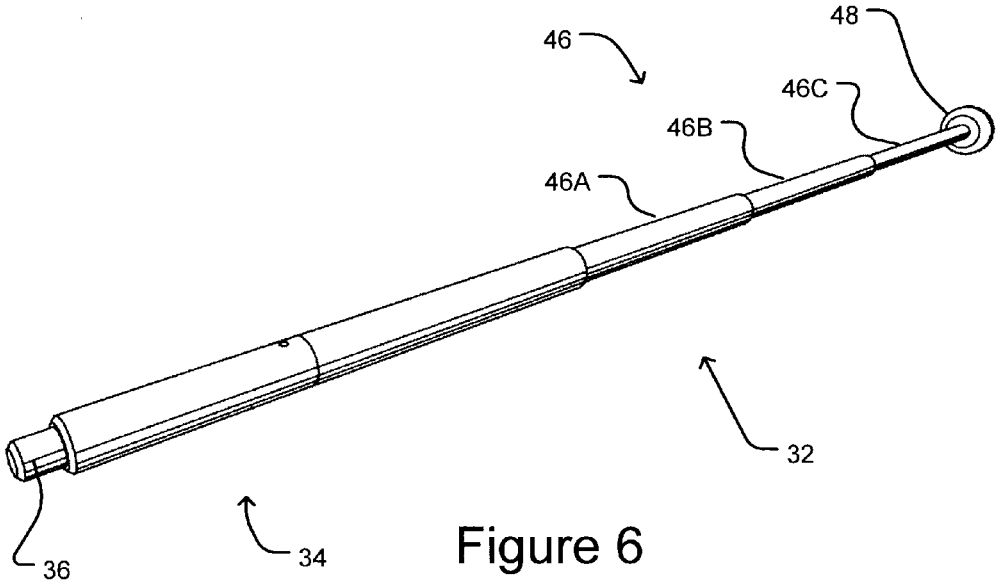
FIG. 6 shows the pole of FIG. 2 in an extended configuration.

As shown in FIG. 6, telescoping part 32 comprises a plurality of telescoping segments 46 (individually enumerated as 46A, 46B and 46C in FIG. 6). A hand grip 48 is attached to the end of the endmost of segments 46 (segment 46C in the illustrated embodiment). Hand grip 48 is generally rounded and knob-shaped in the illustrated embodiment, but other shapes for hand grip 48 are also possible.

Figure 7:
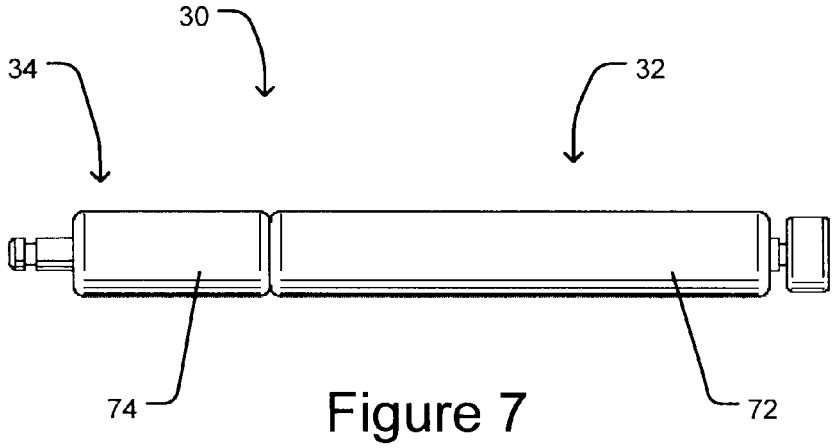
FIG. 7 shows a telescoping pole according to another embodiment of the invention.

Telescoping pole 30 may be configured to float in some embodiments. For example, pole 30 may be covered with neoprene, cork, or the like. For example, FIG. 7 shows pole 30 wherein telescoping part 32 and non-telescoping part 34 are covered with neoprene outer shells 72 and 74, respectively. Pole 30 may additionally or alternatively comprise hollow portions filled with a low density material such as neoprene, polyurethane closed cell foam, cork, or the like.

Figure 8:
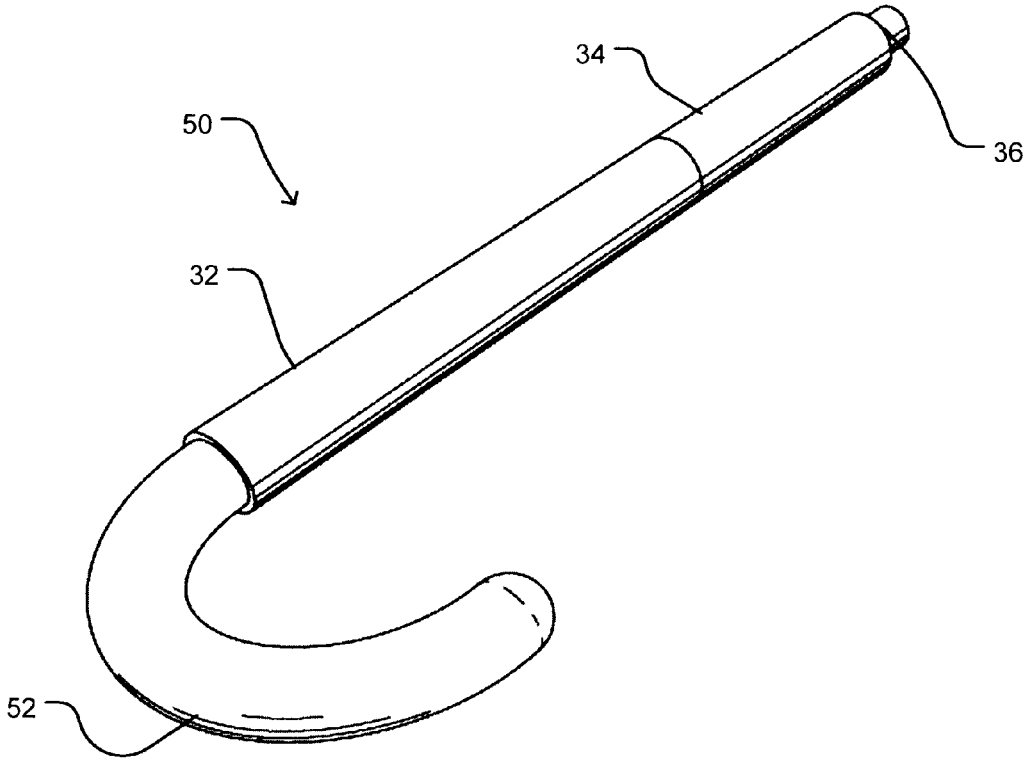
FIG. 8 shows a telescoping pole according to another embodiment of the invention.

FIG. 8 shows a telescoping pole 50 according to another embodiment. Pole 50 has a hook 52 in place of hand grip 48, but is otherwise the same as pole 30 described above.

While a number of exemplary aspects and embodiments have been discussed above, those of skill in the art will recognize certain modifications, permutations, additions and sub-combinations thereof. For example:

- the number and placement of floatation devices 14 may be different than as shown in FIG. 1;
- the number and placement of pockets 16 may be different than as shown in FIG. 1;
- structures other than hand grip 48 or hook 52 may be provided at the end of the telescoping pole to facilitate gripping by a user, such as, for example, a handle, a loop of fabric or other material, or the like.

It is therefore intended that the following appended claims and claims hereafter introduced are interpreted to include all such modifications, permutations, additions and sub-combinations as are within their true spirit and scope.

What is claimed is:

1. An apparatus for cold water survival, the apparatus comprising:

an elongated belt body comprising a piece of buoyancy-providing material, the belt body sized such that end portions thereof overlap when the belt body is wrapped around a user's waist, the belt body having an inner side which faces the user when the belt body is wrapped around the user's waist and an outer side which faces away from the user when the belt body is wrapped around the user's waist;

one or more fasteners for holding the belt body in place around the user's waist;

a plurality of flotation devices attached to the outer side of the belt body;

a plurality of pockets attached to the outer side of the belt body;

a mounting mechanism attached to the outer side of the belt body; and, a telescoping pole held by the mounting mechanism, wherein the telescoping pole is separable into a telescoping part and a non-telescoping part; and wherein the telescoping part has a reduced diameter portion at one end thereof sized to be received in an opening defined in an end of the non-telescoping part, and wherein the reduced diameter portion of the telescoping part defines an L-shaped slot therein and the non-telescoping part comprises a protrusion extending into the opening, the protrusion configured to be received in the slot such that the telescoping part and the non-telescoping part may be secured together by inserting the reduced diameter position into the opening with the protrusion aligned with the slot, then twisting the telescoping part and the non-telescoping part relative to each other.

2. An apparatus according to claim 1 wherein the mounting mechanism comprises a clip configured to hold the telescoping pole.

3. An apparatus according to claim 2 wherein the clip is rotatable with respect to the belt body.

4. An apparatus according to claim 2 wherein the mounting mechanism comprises a plurality of mounting plates attached to a plurality of locations on the outer side of the belt body, each mounting plate configured to receive the clip.

5. An apparatus according to claim 1 wherein the mounting mechanism comprises a sleeve, the sleeve positioned such that when the belt body is wrapped around the user's waist, the sleeve is horizontally-oriented and located in front of the user.

6. An apparatus according to claim 1 wherein the mounting mechanism comprises a plurality of loops made from a stretchable material.

7. An apparatus according to claim 1 wherein the telescoping part comprises a first spike extending from the reduced diameter portion, and wherein the non-telescoping part comprises a second spike at the end thereof opposite the opening, such that the user can establish first and second handholds on a surface by pressing the first and second spikes into the surface.

8. An apparatus according to claim 7 wherein the non-telescoping part comprises a retractable spike cover which is biased into an extended position wherein the retractable spike cover covers the second spike, whereby the retractable spike cover may be forced back to a retracted position to expose the second spike by pressing the end of the non-telescoping part opposite the opening against the surface.

9. An apparatus according to claim 8 wherein the telescoping part comprises a plurality of telescoping segments, and gripping means attached to an endmost of the plurality of telescoping segments.

10. An apparatus according to claim 9 wherein the gripping means comprises a generally rounded, knob-shaped hand grip.

11. An apparatus according to claim 9 wherein the gripping means comprises a hook.

12. An apparatus according to claim 1 wherein the inner side of the belt body is substantially flat.

13. An apparatus according to claim 1 wherein the flotation devices protrude outward from the outer side of the belt body by about one inch.

14. An apparatus according to claim 1 wherein the belt body has a height of about 9 to 12 inches such that the belt body provides lumbar support to the user.

15. An apparatus according to claim 1 wherein the fasteners comprise adjustable straps.

16. An apparatus according to claim 15 wherein the fasteners further comprise hook and loop fasteners.

* * * * *